US006513582B2

(12) United States Patent
Krupa et al.

(10) Patent No.: US 6,513,582 B2
(45) Date of Patent: Feb. 4, 2003

(54) HEAT EXCHANGER AND FLUID PIPE THEREFOR

(75) Inventors: Andrzej Krupa, Ostrow (PL); Jan Ibron, Ostrow (PL); Marek Filipiak, Ostrow (PL)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/883,143

(22) Filed: Jun. 14, 2001

(65) Prior Publication Data

US 2002/0005281 A1 Jan. 17, 2002

(30) Foreign Application Priority Data

Jul. 11, 2000 (GB) ..... 0016879

(51) Int. Cl.[7] ..... F28F 1/40
(52) U.S. Cl. ..... 165/133; 165/183; 29/890.053
(58) Field of Search ..... 165/177, 133, 165/183

(56) References Cited

U.S. PATENT DOCUMENTS 6,000,461 A 12/1999 Ross et al. ..... 165/79

FOREIGN PATENT DOCUMENTS

| | | | | |
|---|---|---|---|---|
| EP | 0302232 | | 2/1989 | |
| FR | 2716529 | A1 * | 8/1995 | ..... F28F/1/02 |
| FR | 2756371 | A1 * | 5/1998 | ..... F28F/1/04 |
| FR | 2756371 | | 5/1998 | |
| FR | 2757258 | A1 * | 6/1998 | ..... B60H/1/00 |
| GB | 2268260 | A | 1/1994 | |
| GB | 2324145 | A | 10/1998 | |
| JP | 10193085 | | 7/1998 | |
| JP | 2000158070 | | 6/2000 | |

* cited by examiner

*Primary Examiner*—Allen Flanigan
(74) *Attorney, Agent, or Firm*—Patrick M. Griffin

(57) ABSTRACT

A fluid pipe (14) for fluid flow between a pair of manifolds of a heat exchanger and which is formed from a single piece of sheet metallic material having a cladding on at least one surface, the fluid pipe having a first side wall (40) having a first portion (46) and a second portion (48); a second side wall (42) extending substantially parallel to and spaced from the first side wall; a pair of end walls (44) connecting the first and second side walls; first, second and third internal walls (50–54) positioned internally of the first and second side walls and the end walls, the first, second and third internal walls being spaced apart and spaced from the end walls, and extending between the first and second side walls, the first internal wall being of double the thickness of the sheet and being positioned intermediate the second and third internal walls; a first planar side portion (56) connecting the first and second internal walls and contacting a first planar part (58) of the internal surface of the second side wall; a second planar side portion (60) connecting the first and third internal walls and contacting a second planar part (62) of the internal surface of the second side wall; a third planar side portion (64) connected to the second internal wall and contacting a planar part (66) of the internal surface of the first portion of the first side wall; and a fourth planar side portion (68) connected to the third internal wall and contacting a planar part (70) of the internal surface of the second portion of the first side wall. The invention also includes a heat exchanger having a number of such fluid pipes. The fluid pipes of the present invention have increased strength over known arrangements.

1 Claim, 2 Drawing Sheets

HEAT EXCHANGER AND FLUID PIPE THEREFOR

TECHNICAL FIELD

The present invention relates to a heat exchanger, and in particular to a fluid pipe for use in a heat exchanger.

BACKGROUND OF THE INVENTION

Heat exchangers are well known in air conditioning systems, refrigerant systems, and as radiators (for example, in motor vehicles). Such known heat exchangers include a pair of header tanks or manifolds which are fluidly connected by fluid pipes which extend between the manifolds. In general, the fluid pipes are formed by extrusion and then brazed to the manifolds. The fluid pipes may be extruded with two or more adjacent, longitudinally extending, channels. In an alternative arrangement, as described in EP-A-0302232 and EP-A-0646231, the fluid pipes may be formed from sheet metal by folding and then soldering.

SUMMARY OF THE INVENTION

It is an object of the present invention to provide an improved fluid pipe for a heat exchanger.

A fluid pipe in accordance with the present invention for fluid flow between a pair of manifolds of a heat exchanger and which is formed from a single piece of sheet metallic material having a cladding on at least one surface, comprising a first side wall having a first portion and a second portion; a second side wall extending substantially parallel to and spaced from the first side wall; a pair of end walls connecting the first and second side walls; first, second and third internal walls positioned internally of the first and second side walls and the end walls, the first, second and third internal walls being spaced apart and spaced from the end walls, and extending between the first and second side walls, the first internal wall being of double the thickness of the sheet and being positioned intermediate the second and third internal walls; a first planar side portion connecting the first and second internal walls and contacting a first planar part of the internal surface of the second side wall; a second planar side portion connecting the first and third internal walls and contacting a second planar part of the internal surface of the second side wall; a third planar side portion connected to the second internal wall and contacting a planar part of the internal surface of the first portion of the first side wall; and a fourth planar side portion connected to the third internal wall and contacting a planar part of the internal surface of the second portion of the first side wall.

The present invention also includes a heat exchanger having a number of fluid pipes in accordance with the present invention.

The present invention provides fluid tubes which are formed by rolling and folding from a sheet of metallic material which is clad on at least one surface. On subsequent assembly into a heat exchanger, the fluid pipes and the other components of the heat exchanger can be brazed together in a single brazing operation. The fluid pipes of the present invention have increased strength over known arrangements.

BRIEF DESCRIPTION OF THE DRAWINGS

The present invention will now be described, by way of example, with reference to the accompanying drawings, in which.

DESCRIPTION OF THE PREFERRED EMBODIMENT

Figure 1:
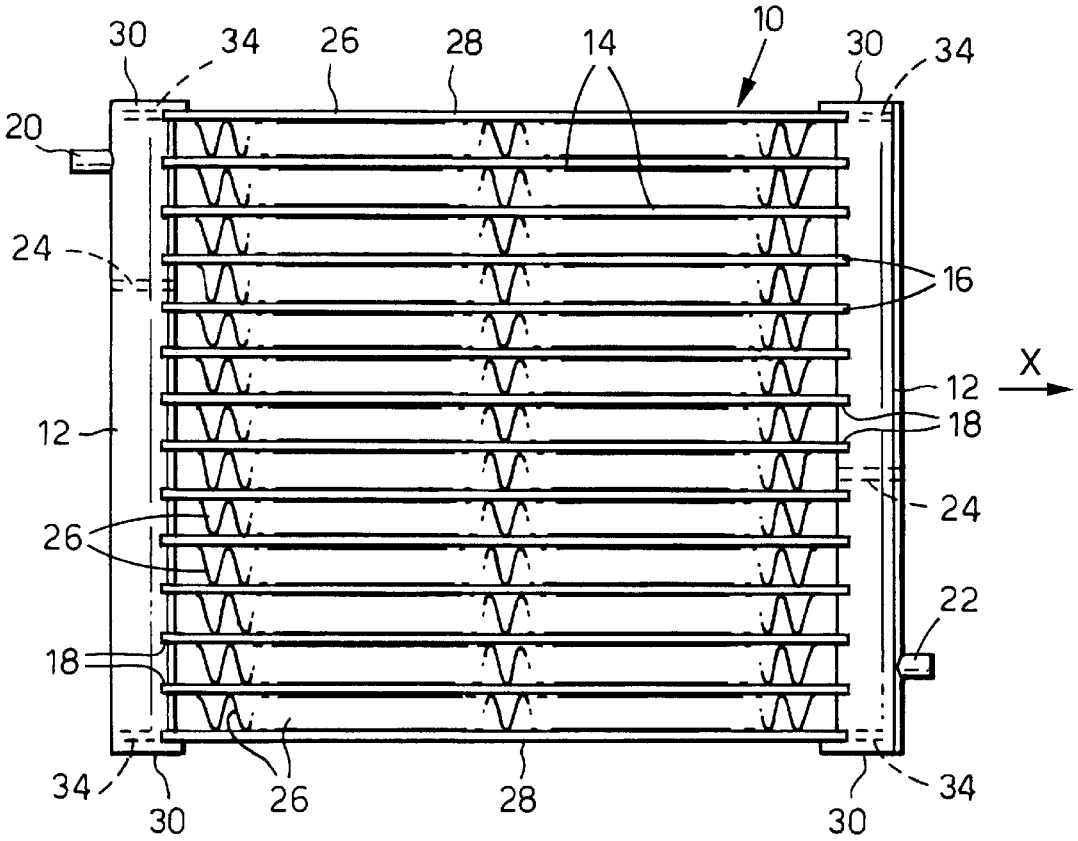
FIG. 1 is a side view of a heat exchanger in accordance with the present invention.
Figure 2:
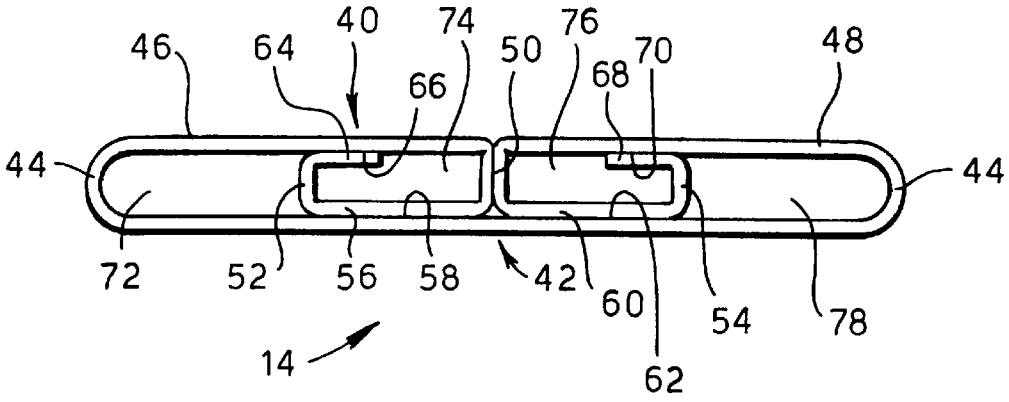
FIG. 2 is an end view of one of the fluid pipes, in accordance with the present invention, of the heat exchanger of FIG. 1.

Referring to FIGS. 1 and 2 of the drawings, a heat exchanger 10 in accordance with the present invention comprises a pair of manifolds or header tanks 12 which are spaced apart and which extend in a direction substantially parallel to one another. A number of fluid pipes 14 extend between the manifolds 12. The fluid pipes 14 are spaced apart and extend in a longitudinal direction X substantially parallel to one another, and substantially perpendicular to the axial direction of the manifolds 12. Each end 16 of each fluid pipe 14 is located in a corresponding slot 18 formed in the manifolds 12 to allows fluid flow between the fluid pipes and the manifolds. A fluid inlet pipe 20 is connected to one of the manifolds 12, and a fluid outlet pipe 22 is connected to the other manifold 12 (or alternatively to the same manifold as the inlet fluid pipe). One or more baffle plates 24 may be secured inside the manifolds 12 to provide predetermined fluid flow path through the manifolds and the fluid pipes 14. The positioning of the fluid inlet pipe 20, the fluid outlet pipe 22, and the baffles plates 24, may be changed as required, or the baffles plates may be omitted. Sinusoidal fins 26 are positioned between, and in contact with, adjacent fluid pipes 14. The fins 26 act to provide improved heat transfer between the fluid in the fluid pipes 14 and air flowing through the heat exchanger 10 between the fluid pipes. End caps 34 are positioned at each end 30 of the manifolds 12 to fluidly close the manifolds. A pair of reinforcement plates 28 may extend between the manifolds 12 outwardly of the fluid pipes 14. The heat exchanger 10 is manufactured by assembling the above mentioned components and then brazing to secure the components together and form fluid tight joints where required.

Each fluid pipe 14 is formed in one piece from a sheet of aluminium alloy which has a cladding material on at least one side, and which is substantially rectangular before formation into the fluid pipe. The sheet is rolled and folded to form the fluid pipe 14, with the clad side of the sheet being outermost (when clad on one side only). As can be seen in FIG. 2, the fluid pipe 14 is formed with a first side wall 40 and a second side wall 42 which extend in the longitudinal direction substantially parallel to one another, are substantially planar, and which are connected by end walls 44. The first wall 40 has first and second portions 46, 48 which are folded inwardly at their free edge to form first, second and third internal walls 50, 52, 54 internally of the side walls 40, 42 and the end walls 44. Each of the internal walls 50–54 extends in the longitudinal direction X and contacts the first and second side walls 40, 42. The internal walls 50–54 are preferably substantially perpendicular to the side walls 40, 42. The first internal wall 50 is defined by a double thickness of the sheet (with one part attached to the first portion 46 of the first side wall 40 and the other part attached to the second portion 48 of the first side wall) and is located intermediate the second and third internal walls 52, 54. The first internal wall 50 and the second internal wall 52 are connected by a first planar side portion 56 which contacts a first planar part 58 of the inner surface of the second side wall 42. The first internal wall 50 and the third internal wall 54 are connected by a second planar side portion 60 which contacts a second planar part 62 of the inner surface of the second side wall 42.

A third planar side portion 64 is formed at the edge of the second internal wall 52 adjacent the first portion 46 of the first side wall 40. The third planar side portion 64 extends towards the first internal wall 50 and engages a planar part 66 of the inner surface of the first portion 46 of the first side wall 40. A fourth planar side portion 68 is formed at the edge of the third internal wall 54 adjacent the second portion 48 of the first side wall 40. The fourth planar side portion 68 extends towards the first internal wall 50 and engages a planar part 70 of the inner surface of the second portion 48 of the first side wall 40.

With this arrangement, the fluid pipe 14 has four separate fluid channels 72–78 extending through the fluid pipe in the longitudinal direction X. The presence of the cladding secures the double thickness of the first internal wall 50 together; secures the first and second planar side portions 56, 60 to the second side wall 42; and secures the third and fourth planar side portions 64, 68 to the first side wall 40; during the brazing process.

Figure 3:
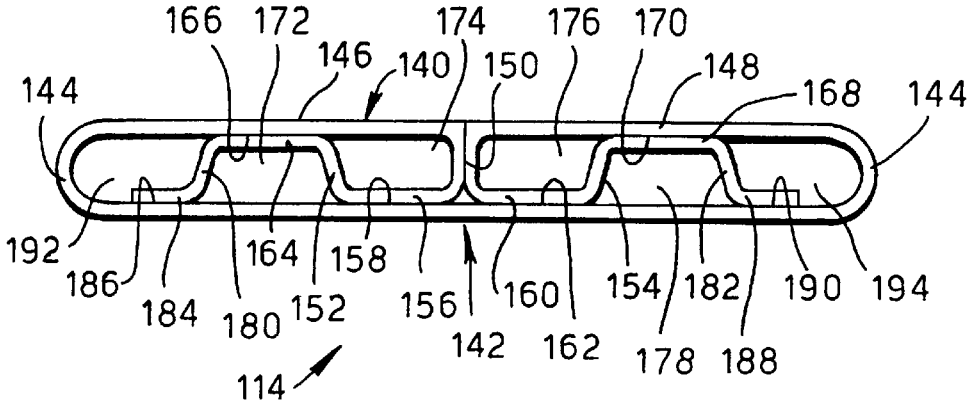
FIG. 3 is an end view of an alternative fluid pipe in accordance with the present invention.

FIG. 3 shows a second embodiment of fluid pipe 114 in accordance with the present invention. In this second embodiment, like parts have the same reference numeral as in FIG. 2 except with the addition of 100, and the sheet from which the fluid pipe 114 is formed has cladding material on both surfaces. In this second embodiment, the third and fourth planar side portions 164, 168 of the fluid pipe 114 are directed away from the first internal wall 150. The fluid pipe 114 further comprises a fourth internal wall 180 connected to the third planar side portion 164 and positioned between the second internal wall 152 and the adjacent end wall 144, and a fifth internal wall 182 connected to the fourth planar side portion 168 and positioned between the third internal wall 154 and the adjacent end wall. The fourth and fifth internal walls 180, 182 extend in the longitudinal direction X and extend between the first and second side walls 140, 142. A fifth planar side portion 184 is formed at the edge of the fourth internal wall 180 adjacent the second side wall 142. The fifth planar side portion 184 extends away the first internal wall 150 and engages a third planar part 186 of the inner surface of the second side wall 142. A sixth planar side portion 188 is formed at the edge of the fifth internal wall 182 adjacent the second side wall 142. The sixth planar side portion 188 extends away the first internal wall 150 and engages a fourth planar part 190 of the inner surface of the second side wall 142. In an alternative arrangement, the fifth and sixth planar side portions 184, 188 may be directed towards the first internal wall 150. The first internal wall 150 is preferably substantially perpendicular to the first and second side walls 140, 142. The second, third, fourth and fifth internal walls 152, 154, 180, 182 extend between the first side wall 140 and the second side wall 142 preferably at a small angle to the perpendicular direction.

With this arrangement, the fluid pipe 114 has six separate fluid channels 172–178, 192, 194 extending through the fluid pipe in the longitudinal direction X. The presence of the cladding on both surfaces secures the double thickness of the first internal wall 150 together; secures the first, second, fifth and sixth planar side portions 156, 160, 184, 188 to the second side wall 142; and secures the third and fourth planar side portions 164, 168 to the first side wall 140; during the brazing process.

Forming the fluid pipes by rolling and folding from a sheet of metallic material (instead of extruding) allows for thinner pipe walls, reduced costs, and improved assembly operation. The use of sheet material with a cladding on at least one surface allows the fluid pipes to be brazed at the same time as the brazing process for the heat exchanger as a whole. The present invention provides a strong construction for the fluid pipes which is capable of withstanding high fluid pressures, is more resistant to potential crushing, and has increased stiffness, when compared to known folded fluid tubes, due in part to the planar attachments between the side portions and the side walls. Also, the present invention can provide four or more fluid passages with a reduced number of folding operations when compared to EP-A-0302232, and with reduced risk of leakage at the joint with the header tanks.

The present invention has particular application for heat exchangers used in the air conditioning system or heating system of a motor vehicle, or the radiator used for cooling engine coolant in a motor vehicle. The present invention could, however, also be used for heat exchangers having other applications.

What is claimed is:

1. A fluid pipe for fluid flow between a pair of manifolds of a heat exchanger and which is formed from a single piece of sheet metallic material having a cladding on only one surface, the fluid pipe having a first side wall with said cladding on the external surface thereof and having a first portion and a second portion; a second side wall with said cladding on the external surface thereof and extending substantially parallel to and spaced from the first side wall; a pair of end walls connecting the first and second side walls; first, second and third internal walls positioned internally of the first and second side walls and the end walls, the first, second and third internal walls being spaced apart and spaced from the end walls, and extending between the first and second side walls, the first internal wall being of double the thickness of the sheet and being positioned intermediate the second and third internal walls; a first planar side portion with said braze cladding on the external surface thereof connecting the first and second internal walls and contacting a first planar part of the internal surface of the second side wall with said clad external surface; a second planar side portion with said braze cladding on the external surface thereof connecting the first and third internal walls and contacting a second planar part of the internal surface of the second side wall with said clad external surface; a third planar side portion connected to the second internal wall and directed towards the first internal wall so as to contact a planar part of the internal surface of the first portion of the first side wall with said one clad surface; and a fourth planar side portion connected to the third internal wall and also directed towards the first internal wall so as to contact a planar part of the internal surface of the second portion of the first side wall with said one clad surface.

* * * * *